US005122293A

United States Patent [19]

Eusebi et al.

[11] Patent Number: 5,122,293

[45] Date of Patent: Jun. 16, 1992

[54] METHOD OF ACTIVATING AND DEACTIVATING AN ELECTRORHEOLOGICAL RESPONSE AT CONSTANT ALTERNATING CURRENT

[75] Inventors: Elio Eusebi, Troy; Robert T. Foister, Rochester, both of Mich.

[73] Assignee: General Motors Corporation, Detroit, Mich.

[21] Appl. No.: 684,759

[22] Filed: Apr. 15, 1991

[51] Int. Cl.[5] ..... C10M 125/30; C10M 169/04

[52] U.S. Cl. ..... 252/75; 252/73; 252/74; 252/572

[58] Field of Search ..... 252/73, 572, 74, 75; 137/13, 827; 192/21.5; 267/140.1; 188/268, 269

[56] References Cited

U.S. PATENT DOCUMENTS

| | | | |
|---|---|---|---|
| 2,417,850 | 3/1947 | Winslow | 175/320 |
| 2,492,210 | 12/1949 | Clark | 252/579 |
| 3,047,507 | 7/1962 | Winslow | 252/75 |
| 3,839,252 | 10/1974 | Bosso et al. | 260/29.2 EP |
| 4,645,614 | 2/1987 | Goossens et al. | 252/75 |
| 4,655,842 | 4/1987 | Ou et al. | 106/288 B |
| 4,687,589 | 8/1987 | Block et al. | 252/581 |
| 4,744,914 | 5/1988 | Filisko et al. | 252/74 |
| 4,772,407 | 9/1988 | Carlson | 252/74 |
| 4,879,056 | 11/1989 | Filisko et al. | 252/74 |

FOREIGN PATENT DOCUMENTS

| | | |
|---|---|---|
| 0311984 | 4/1989 | European Pat. Off. . |
| 54-42378 | 4/1979 | Japan . |
| 61-241379 | 10/1986 | Japan . |
| 1-253110 | 10/1989 | Japan . |
| 2-55792 | 2/1990 | Japan . |
| WO82/04442 | 12/1982 | PCT Int'l Appl. . |
| 1570234 | 6/1980 | United Kingdom . |

OTHER PUBLICATIONS

Klass et al., "Electroviscous Fluids", J. Appl. Phys. vol. 38, No. 1, pp. 67-80, 1967.

Block et al., "Electro-rheology", J. Phys. D: Appl. Phys., 21(12), 1661-77, 1988.

Matsepuro, "Structure Formation in an Electric Field and the Composition of Electrorheological Suspensions", translated from Elektroreal Issled PriliMinsk pp. 27-51, 1981.

ICA Translations Number 30657 of Japanese Patent No. 2-55792, "Functional Fluid".

*Primary Examiner*—Paul Lieberman
*Assistant Examiner*—Christine A. Skane
*Attorney, Agent, or Firm*—Cary W. Brooks

[57] ABSTRACT

Disclosed are electrorheological fluids including vermiculite treated with an amine salt, methods of making the same, propylene carbonate adsorbed on the solid phase, butyl benzoate added for the liquid phase, and methods of using frequency response of electrorheological fluids to vary apparent viscosity and to compensate for temperature.

4 Claims, 2 Drawing Sheets

METHOD OF ACTIVATING AND DEACTIVATING AN ELECTRORHEOLOGICAL RESPONSE AT CONSTANT ALTERNATING CURRENT

PATENT APPLICATIONS OF INTEREST

The following patent applications may be of interest: application Ser. Nos. 07/684,748, 07/684,147, 07/684,749 and 07/684,750 all entitled "Electrorheological Fluids and Method of Making and Using the Same". The above patent applications were all filed on Apr. 15, 1991 by one or more of the same coinventors. The differences between the applications will become apparent by reviewing the Summary of the Invention section and claims of each application and by reviewing comments concerning specific embodiments in the Detailed Description of the Invention section of this application.

FIELD OF THE INVENTION

The present invention relates to fluid compositions which demonstrate significant changes in their fluid properties in the presence of an electrical field.

BACKGROUND OF THE INVENTION

Electrorheological response is a phenomenon in which the rheology of a fluid is modified by the imposition of an electrical field. Fluids which exhibit significant changes in their properties of flow in the presence of an electrical field have been known for several decades. The phenomena of electrorheology was reported by W. M. Winslow, U.S. Pat. No. 2,417,850, in 194 Winslow demonstrated that certain suspensions of solids in liquids show large, reversible electrorheological effects. In the absence of electrical field, electrorheological fluids generally exhibit Newtonian behavior. That is, the applied force per unit area, known as shear stress, is directly proportional to the shear rate, i.e., relative velocity per unit thickness. When an electrical field is applied, a yield stress phenomena appears and no shearing takes place until the shear stress exceeds a yield value which generally rises with increasing electrical field strength. This phenomenon can appear as an increase in apparent viscosity of several, and often many orders of magnitude. The response time to electrical fields is frequently in the order of milliseconds. This rapid response characteristics of electrorheological fluids makes them attractive to use as elements in mechanical devices.

A complete understanding of the mechanisms through which electrorheological fluids exhibit their particular behavior has eluded workers in the art. Many have speculated on the mechanisms giving rise to the behavior characteristics of electrorheological fluids. A first theory is that the applied electrical field restricts the freedom of particles to rotate, thus changing their bulk behavior. A second theory describes a change in properties to the formation of filament-like aggregates which form along the lines of the applied electrical field. One theory proposes that this "induced fibrillation" results from small, lateral migrations of particles to regions of high field intensity between gaps of incomplete chains of particles, followed by mutual attraction of these particles.

A third theory refers to an "electric double layer" in which the effect is explained by hypothesizing that the application of electrical field causes a layer of materials adsorbed upon the discrete phase particles to move, relative to the particles, in the direction along the field toward the electrode having a charge opposite that of the mobile ions in the adsorbed layer.

Yet another theory proposes that the electrical field drives water to the surface of discrete phase particles through a process of electro-osmosis. The resulting water film on the particles then acts as a glue which holds particles together.

Criticism of a simple fibrillation theory has been made on the grounds that the effect is much too rapid for such intensive structure formation to occur. Workers in the art have observed a time scale for fibrillation of approximately 20 seconds, which is vastly in excess of the time scale for rheological response of electrorheological fluids. Some workers suggest the sequence of events as a possible mechanism include: ionic migration, subsequent electro-osmosis of moisture to one pole of the particle (presumably the cationic region) and in consequence, surface supply of water sufficient for bridging. This moisture bridge mechanism is not the lone process by which electrorheological effects occur. The advent of anhydrous electrorheological fluid means that water-bridging is not an essential mechanism and may indeed not be operative at all.

Despite the numerous theories and speculations, it is generally agreed that the initial step in development of electrorheological behavior involves polarization under the influence of an electrical field. This then induces some form of interaction between particles or between particles and the impressed electric or shear fields which results in the rheological manifestations of the effect. See Carlson, U.S. Pat. No. 4,772,407 Block et al "Electro-Rheology", IEEE Symposium, London, 1985. Despite this one generally accepted mechanism, the development of suitable electrorheological fluids and methods of improving the same remains largely unpredictable.

The potential usefulness of electrorheological fluids in automotive applications, such as vibration damping, shock absorbers, or torque transfer, stems from their ability to increase, by orders of magnitude, their apparent viscosity upon application of electrical field. This increase can be achieved with very fast (on the order of milliseconds) response times and with minimal power requirements. Although ER-fluids have been formulated and investigated since the early 1940's, basic limitations have prevented their utilization in practical devices. The most severely restrictive of these limitations are (1) that the suspensions be stable, i.e., should be readily redispersible upon standing, even if settlementation occurs and (2) they not suffer from the limitation imposed by the presence of water so that at extended temperatures, i.e., outside of 0–100 degrees C., service and durability can be achieved. This latter requirement is particularly restrictive in that most fluid compositions require water as an ER "activator" so that in completely dry systems the ER-effect is entirely absent or so small that it is not effectively useful.

An object of this invention is to formulate a stable, substantially water free, or non-aqueous ER-fluid with improved properties. In other words, one goal of this invention to remove the water without compromising the electrorheological effect.

SUMMARY OF THE INVENTION

This invention includes a method of changing the frequency of an applied field at a given operating temperature to enhance or attenuate the ER-effect or to activate (i.e., turn on) or deactivate (i.e., turn off) the ER-effect between on and off.

These and other objects, features and advantages of this invention will be apparent from the following detailed description, appended drawings and claims.

DETAILED DESCRIPTION OF THE INVENTION

Figure 1:
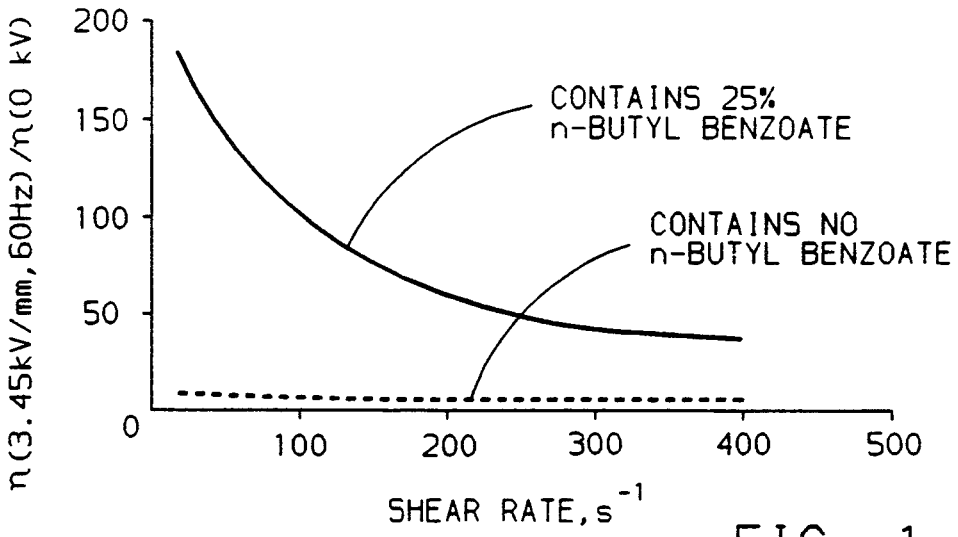
FIG. 1 is a graphic illustration of the effect on viscosity of an ester additive to an electrorheological fluid.

Vermiculite is a gold-colored mineral having the formula $3MgO(FeAl)_2O_3,3SiI_2$, Chemically defoliated vermiculite, in a plate-like Al-Mg sheet silicate form, is commercially available from W. R. Grace, Inc., under the trade name MICROLITE 903 TM . The term "plate-like Al-Mg sheet silicate form" means that the particles are made up of multiple layered planes ("sheets") consisting of extensive Si-O linkages (silicate). The planes are ionically bonded via cations such as $Al^{3+}$and $Mg^{2+}$. In this commercial form, the vermiculite is hydrophilic which makes it a) difficult to disperse in typical base electrorheological fluid phases such as silicon oils and hydrocarbons and b) is not likely to stay dispersed. If the vermiculite does not stay dispersed, it settles and forms a cake material. This is undesirable because considerable mechanical energy must be expended to continually re-disperse the solid in order for the material to function as an electrorheological fluid. The present invention provides a method of treating this vermiculite to achieve advantageous results.

In one embodiment of this invention, chemically delaminated vermiculite plates are surface treated with an organic amine salt. An ionic bond is formed between the vermiculite and amine salt. The amine salt serves two purposes. First, the amine salt allows the vermiculite, after proper drying, to form a very stable dispersion with silicon oil or other non-aqueous liquids such as hydrocarbon liquid phase materials. Second, the amine salt allows the individual plate-like vermiculite particles to be polarized in an electrical field without the presence of water, the polarization of the particles is a necessary requirement for a system to demonstrate an ER behavior. The geometry of the plate-like vermiculite particles produce a greater polarization in an electric field than other shapes. Preferably, the plate-like vermiculite has an average face diameter range from about 1 to about 30 micrometers, and a particle thickness of about 60 to about 100 Angstroms. The vermiculite may be present in an amount range from about 5 to about 50, and preferably about 10 to about 30 percent by weight of the composition. Aspects of this embodiment are claimed in the U.S. patent application 07/684,748 entitled "Electrorheological Fluids and Methods of Making and Using the Same", filed on Apr. 15, 1991 by one or more of the same coinventors.

The chemically defoliated vermiculite is surface treated by exchanging lithium on the surface of an amine cation. The amine cation may be primary, secondary, tertiary and preferably is a quaternary ammonium salt. Suitable treating materials are amines salts including at least one selected from the group consisting of alkyl ammonium halides, preferably with an alkyl group having 2 to 18 carbons, and most preferably 12 carbons or dodecylamine salt. Suitable amine salts, and particularly quaternary ammonium salts, contemplated including listed in Bosso et al, U.S. Pat. No. 3,839,252 which is hereby incorporated by reference.

A quaternary ammonium salt is a type of organic nitrogen compound in which the molecular structure includes a central nitrogen atom joined to four groups (the cation) and an anion, the structure as indicated as:

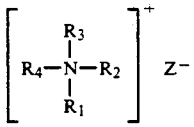

wherein $R_1$, $R_2$, $R_3$ and $R_4$ are alkyl or aromatic groups or hydrogen, and wherein at least one of the R-groups having from 2 to 18 carbons and the other R-groups having from 2 to 18 carbon atoms.

Particularly suitable quaternary ammonium salts include at least one selected from the group consisting of octadecyldimethylbenzyl ammonium chloride, hexamethonium chloride, and lauryl pyridinium chloride.

Typically, the vermiculite is placed in a solution of amine salts comprising the amine salt and deionized water as a solvent. The equivalent of amine in solution to vermiculite may range from to 1, preferably 2 to 1 and most preferably 1 to 1. The time period for which the vermiculite is treated may range, depending on temperature, from 3 to 24 hours, preferably 3 to 12 hours and most preferably 6 to 12 hours at room temperature. Higher temperature require less time to treat the particle. The attached hydrocarbon chain on the treated material will render it substantially hydrophobic, thereby increasing its inherent dispersity as well as its stability towards coagulation.

Next, excess amine is removed from the treated material by washing with ethanol. The solid is filtered and dried under house vacuum at a temperature ranging from 60° C. to 110° C,, preferably 75° C. to 110° C. and most preferably 100 degrees C., which is less than that which will cause change in the surface treatment but high enough to promote removal of residual water in a reasonably short time period. The dried treated vermiculite is substantially free of water. The term "substantially free of water" means less than 1% by weight water adhering to the vermiculite. Preferably, the amount of water adhering to the vermiculite is less than that required (approximately 6-10% by weight) for the water to be an "activator" of ER response. That is, the amount of water adhering to the vermiculite is not sufficient to create water bridges between particles in the influence of an electrical field. This drying is preferably carried out under vacuum to a constant pressure ranging from about 100 to 500 mTorr, preferably 100 to 250 and most preferably at least 150 mTorr.

The resultant, treated and dried materials are then dispersed in a base fluid composition by ball milling for 22 hours. The ball milling substantially reduces the average face diameter to the range of from about 5 to 25 mm, preferably 1-5 mm, more preferably about 1 mm to about 3 mm, and most preferably less than 1 micrometer which also promotes suspension stability and dispersibility. The ball milling base fluid may comprise any suitable fluid known in the art, and is preferably 75% silicon oils/25% butyl benzoate. Other suitable ball milling fluids include mineral oils or a material that is to be used as the liquid phase of the ER fluid.

Suitable liquid phase materials are disclosed in Block et al, "Electro-Rheology", IEEE Symposium, London, 1985, which is hereby incorporated by reference. A suitable silicone oil is commercially available from Dow Corning Corporation under the trade name Dow Corning 200 Fluid (20cS) TM, The following example illustrates one embodiment of the present invention:

EXAMPLE I

A defoliated vermiculate suspension is prepared by adding about 7 to about 15 grams of chemically defoliated vermiculite to about 1 to about 100 ml of deionized water. A suitable chemically defoliated vermiculite is MICROLITE 903 TM. The aqueous defoliated vermiculite suspension is added drop-wise to an aqueous solution of excess amine hydrochloride solution, mechanically agitated for six hours, and then filtered. The amine hydrochloride solution may be 6.2% by weight of octylamine or 3.0% of dodecylamine in an aqueous solution. The solid is redispersed and filtered twice with ethanol to remove any excess amine hydrochloride. The solid is then dried in a vacuum at 100 degrees C. until at least a 150 millitorr vacuum is reached. The amine-treated vermiculite is ball milled with a base fluid (e.g., 75% silicon oil/25% butyl benzoate) for 24 hours.

The above procedure was used to prepare a vermiculite treated with octylamine or dodecylamine hydrochloride. Carbon analysis showing the efficiency of surface treatment is listed in Table I. "Efficiency of surface treatment" indicates the percentage of cation exchange.

TABLE I

| | CARBON ANALYSIS* | |
|---|---|---|
| Material | Theoretical | Experimental |
| Octylamine treated | 9.67% | 5.6% |
| Dodecylamine treated | 13.73% | 13.0% |
| Untreated vermiculite | — | 0.41% |

*Analysis performed on LECO Corp. Model CS-444 Carbon/Sulfur Analyzer

For solid phases which require water to achieve polarization under electrical fields, the electrorheological effect decreases when the water is remove. This effect may be restored, and in particular formulations greatly enhanced, by blending into the fluid phase of the electrorheological composition an additional fluid such as a high boiling ester. Suitable esters include at least one selected from the group comprising benzoates, preferably alkyl or adipates. The alkyl group may range from $C_1$ to $C_{18}$ and preferably is n-butyl benzoate. Preferred adipates include diisononyl and adipate and dioctyl adipate, and preferably n-butyl benzoate. The amount of additional liquid may comprise from about 5 to about 75%, preferably 5 to about 50%, and most preferably about 5-25% by volume of the electrorheological fluid. The additional fluid adds to the inherent stability and dispersibility of the treated solid phase as well as acting to lower quite substantially the base fluid viscosity and hence, the zero-field viscosity of the suspension. Aspects of this embodiment are claimed in the U.S. patent application 07/684,750 entitled "Electrorheological Fluids and Methods of Making and Using the Same", filed on Apr. 15, 1991 this application by one or more of the same coinventors.

The primary basis for the utility of electrorheological effect is the change in shear stress (i.e., increase in apparent viscosity) with applied electric field. At zero-field, an electrorheological fluid composition comprising 10% vermiculite treated with dodecylamine, 75% silicon oils/25% butyl benzoate prepared in a manner described above has a viscosity at a shear rate of 400/seconds (which will be standard conditions for the purposes of illustration) of 28 mPa sec (cP). At a field strength of 3.45 kV/mm (AC, 60Hz), the fluid has an apparent viscosity of 1198 mPa sec which is 43 times the zero-field value. This increase in apparent viscosity is greatly magnified as the shear rate decreases. The ratio of viscosity at 3.45 kV/mm to viscosity at zero field as a function of shear rate, is shown in FIG. 1. Also shown for comparison in FIG. 1 is the same plot for the same composition but without butyl benzoate. A comparison of these two plots emphasizes (1) the significant enhancement of electrorheological effects which is achieved by the addition of butyl benzoate and (2) the minimal electrorheological effect exhibited by the nonaqueous system without n-butyl benzoate.

Figure 2:
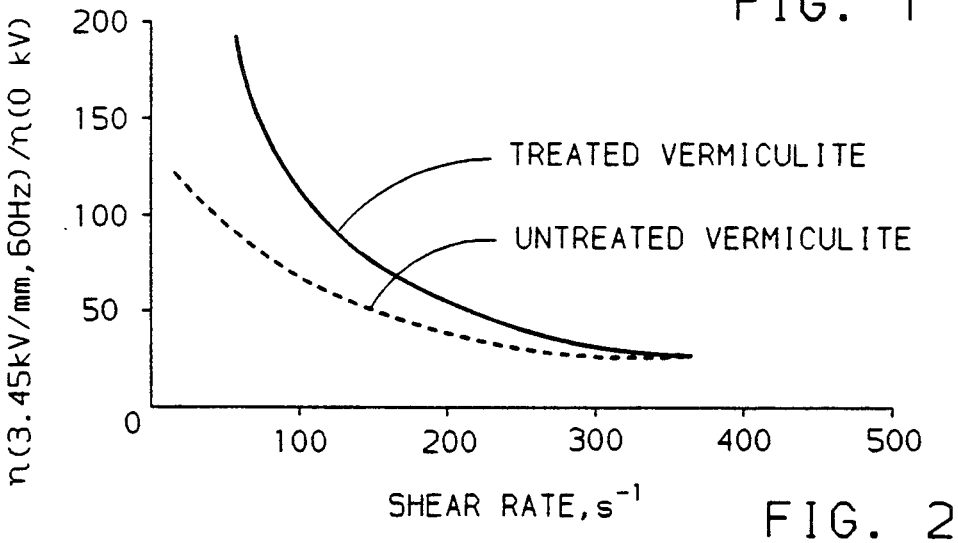
FIG. 2 is a graphic illustration of the effect on viscosity of treating the solid phase of an electrorheological fluid with an amine salt.

FIG. 2 is a plot of the viscosity ratio as a function of shear rate (3.45kV/mm to zero-field). Here the above-described electrorheological composition (illustrated by FIG. 1) is compared to the same composition but with vermiculite particles not treated with an amine as the dispersed phase. Although the electrorheological effect for these two systems is comparable, the vermiculite particles not treated with an amine is basically unstable to the extent that upon repeated application of electric field, large particle aggregates form and precipitate out of the suspension. With time, the fluid will separate into two phases and must be subjected to ball milling to redisperse the solid. This is not the case with the treated vermiculite. After sitting for as long as six months, the solid is readily redispersed by shaking.

Figure 3:
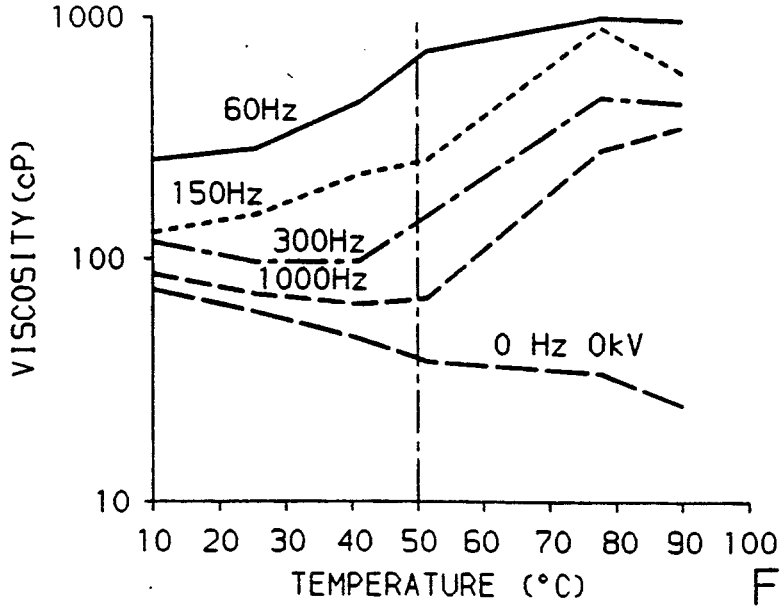
FIG. 3 is a graphic illustration of the effect on viscosity of changing the frequency of an applied field and the temperature of an electrorheological fluid.

Another embodiment of this invention includes a method of changing the frequency of an alternating current electric field applied to an electrorheological fluid and temperature of the fluid to adjust the apparent viscosity of the fluid. The term "apparent viscosity" is the ratio of shear stress to shear rate. An electrorheological fluid comprising 10% solids prepared as described above and a mixture of 25% n-butyl benzoate/75% polydimethylsiloxane fluid was evaluated for change in viscosity as a function of temperature and varying frequencies as shown in FIG. 3. As shown in FIG. 3, in the field off case (lower curve designated 0 kV, 0 Hz), the normal exponential decrease in viscosity (measured at a shear rate of 400/sec) expected for a particulate suspension is observed. The other curve shows significant increases/or decreases of viscosity with temperature depending on the frequency and temperature range. The invention is best illustrated by considering the vertical line at a temperature of 50 degrees C. By continuously changing the frequency, at constant applied potential, from 50Hz to 5000Hz and preferably 60Hz to 1000Hz, any desired viscosity in the range shown can be achieved without changing the applied potential. This method may be adopted to the operation of a device such as a shock absorber, engine mount which requires that the viscosity be varied continuously from the field off value to some maximum value at a given temperature. Further, the frequency may be varied at any given operation temperature to produce a desired viscosity. Analog systems or "look-up tables" may be utilized in this regard.

Figure 4:
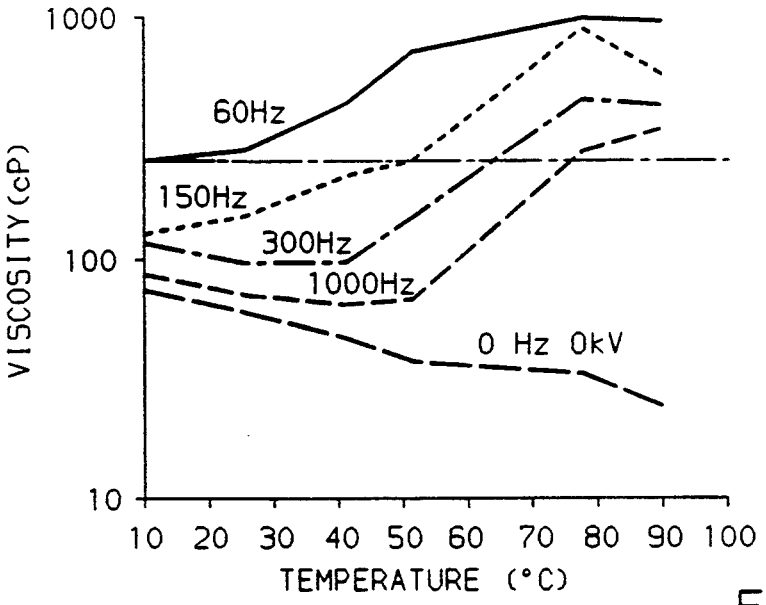
FIG. 4 is a graphic illustration of the effect of varying the temperature of an electrorheological fluid and varying the frequency of an applied field to maintain constant viscosity.

Another embodiment of this invention includes a method of changing the frequency of an alternating current electric field applied to an electrorheological fluid to maintain a constant viscosity over varying temperatures. This embodiment can be best illustrated by FIG. 4 in which it can be seen that to achieve a constant viscosity of 300cP (measured at shear rate of 400/sec) the frequency can be adjusted from 60 Hz to 1000 Hz to compensate for variation in temperatures ranging from 10 degrees C. to approximately 85 degrees C. The data illustrated in FIG. 4 is for an electrorheological fluid prepared as described for the embodiment illustrated by FIG. 3. Aspects of this embodiment are claimed in the U.S. patent application 07/684,747 entitled "Electrorheological Fluids and Methods of Making and Using the Same", filed on Apr. 15, 1991 by one or more of the same coinventors.

Another embodiment of this invention includes a method of activating (i.e., turning on or producing a desired electrorheological effect) or deactivating (i.e., turning off or eliminating an electrorheological effect) an electrorheological response of a fluid under the influence of a substantially constant alternating current electric field comprising varying the frequency of the field to achieve the desired result. The method may be accomplished without substantially varying the temperature of the field.

Another embodiment of this invention may be characterized as a method of producing a predetermined change in the viscosity of an electrorheological fluid including the steps of applying, for a predetermined period, a substantially constant alternating current electric field to the electrorheological fluid and changing the frequency of the electric field from a first level, corresponding to a first viscosity, to a second level, corresponding to a second viscosity at a given shear rate. The difference between the first and second viscosities would be equivalent or equal to the predetermined change in viscosity desired.

Figure 5:
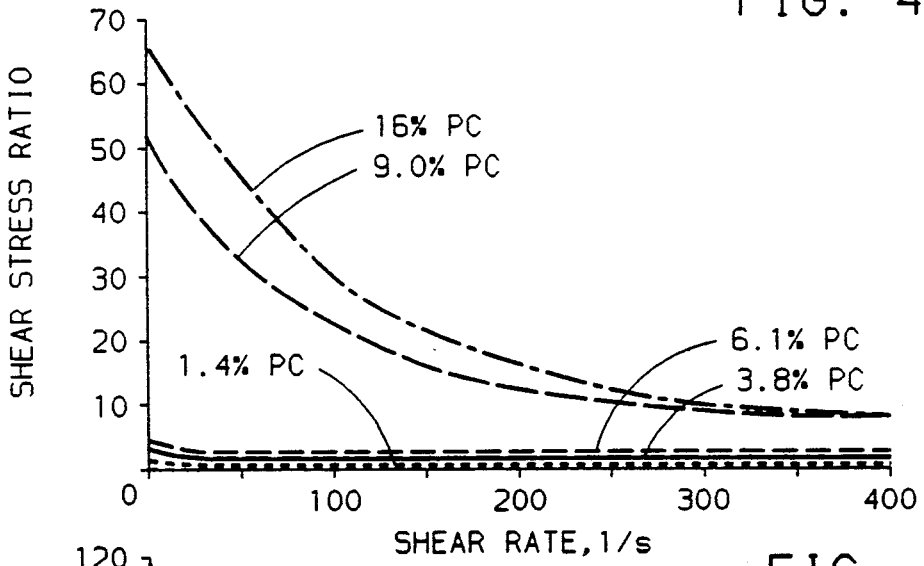
FIG. 5 is a graphic illustration of the effect on viscosity of adsorbing propylene carbonate on the solid phase of an electrorheological fluid.

Another embodiment of this invention includes improvements in performance of the electrorheological fluid achieved by absorption of an activator, preferably propylene carbonate, directly onto the surface of a solid phase. The solid phase of electrorheological fluid is prepared in the manner described above with the additional step of adsorbing an activator directly onto the surface of the solid. Propylene carbonate, which is insoluble in silicon oils, such as polydimethylsiloxane, is adsorbed onto the solid in specific amounts by weight. For example, pre-weighed amounts of a solid such as vermiculite of about 10 to about 50 percent by weight is immersed in ethanol solution containing about 1 to about 25 percent by weight of propylene carbonate. After thorough mixing, ethanol is removed from the solid by heating at about 100 degrees C. under house vacuum for 24 hours. These conditions were chosen to maximize removal of ethanol, leaving maximum amount of propylene carbonate adsorbed onto the solid. The specific amount of adsorbed propylene carbonate was determined by weighing the treated solid. In this fashion, solids were prepared in amounts of adsorbed propylene carbonate ranging from 1.4 to 16% by weight. Preferably the amount of adsorbed propylene carbonate for enhanced electrorheological response ranges from about 9% to about 16%, and preferably about 9 to about 12% by weight. As shown in FIG. 5, little enhancement of the electrorheological effect (measured as a difference in field on [2.07 kV/mm, 60Hz AC] to field off shear stress divided by the field off value) is observed in total amount of propylene carbonate greater than 9% by weight is adsorbed onto the solid. With amounts of 9% by weight or greater adsorbed onto the solid, an increase in effect is registered over the entire shear rate range. The use of an activator adsorbed on the solid phase does not compromise the non-aqueous nature of the fluid. Aspects of this embodiment are claimed in the U.S. patent application 07/684,749 entitled "Electrorheological Fluids and Methods of Making and Using the Same", filed on Apr. 15, 1991 of by one or more of the same coinventors.

Figure 6:
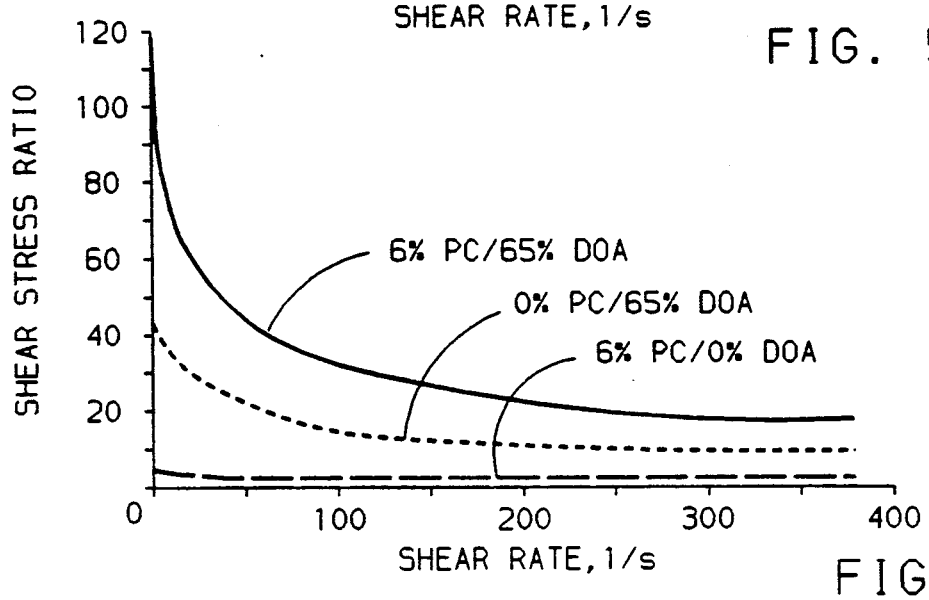
FIG. 6 is a graphic illustration of the effect on viscosity of absorbing propylene carbonate on the solid phase and of an ester additive to an electrorheological fluid.

It has been surprisingly found that the combination of using an adipate such as dioctyladipate (DOA) in the liquid phase and absorbing propylene carbonate on the surface of the solid phase produces more than an additive effect. Electrorheological fluids where prepared having a solid content of about 10% by weight. A first fluid was prepared containing amine treated vermiculite having 6% by weight propylene carbonate adsorbed on the vermiculite and dispersed in silicone oil. The ER response is represented by a curve of FIG. 6. A second material was prepared with amine treated vermiculite in a liquid phase containing 65% by volume DOA and 35% by volume silicone oil. This ER response of the second fluid is represented by a curve of FIG. 6. A third fluid was prepared having amine treated vermiculite having 6% propylene carbonate adsorbed on the vermiculite and a liquid phase containing 65% by volume DOA and 35% by volume silicone oil. The ER response of the third fluid is represented by a curve of FIG. 6. The three fluids were subjected to an electric field strength of 2.07 kV/mm. The ER response of the fluids is plotted as shear stress ratio (that is, the ratio of excess shear stress under field to that same fluid at zero field) versus shear rate. As can be seen, the third fluid has a greater ER response at 50/sec shear rate than the first and second fluids added together. Aspects of this embodiment are claimed in the U.S. patent application 07/684,750 filed on Apr. 15, 1991.

The various embodiments may be combined and varied in a manner within the ordinary skill of persons in the art to practice the invention and to achieve various results as desired.

Where particular aspects of the present invention is defined herein in terms of ranges, it is intended that the invention includes the entire range so defined, and any sub-range or multiple sub-ranges within the broad range. By way of example, where the invention is described as comprising about 1 to about 100% by weight of component A, it is intended to convey the invention as including about 5 to about 25% by weight of component A, and about 50 to about 75% by weight of component A. Likewise, where the present invention has been described herein as including $Al_{1-100}B_{1-50}$, it is intended to convey the invention as $A_{1-60}B_{1-20}$, $A_{60-100}B_{25-50}$ and $A_{43}B_{37}$.

The embodiments of the invention in which an exclusive property or privilege is claimed as defined as follows:

1. A method of activating an electrorheological response of a fluid under the influence of a substantially constant alternating current electric field comprising varying the frequency of the field.

2. A method of deactivating an electrorheological response of a fluid under the influence of a substantially constant alternating current electric field comprising varying the frequency of the field.

3. A method of producing a predetermined change in the viscosity of an electrorheological fluid comprising applying for a predetermined period of time a substantially constant alternating current electric field to the electrorheological fluid and changing the frequency of said electric field from a first level, corresponding to a first viscosity, to a second level, corresponding to a second viscosity, wherein the difference between said first and second viscosities equals said predetermined change in viscosity.

4. A method as set forth in claim 3 wherein the electrorheological fluid comprises amine-treated vermiculite particles in a silicone oil, said alternating current electric field ranges from 1 to 5 kV/mm and said first frequency is greater than 10Hz and said second frequency is less than 10 kHz.

* * * * *